US010449600B2

(12) United States Patent
Zhu et al.

(10) Patent No.: US 10,449,600 B2
(45) Date of Patent: Oct. 22, 2019

(54) PLUNGER FOR STRENGTHENING SPOKE ROOT R ANGLE COOLING

(71) Applicant: CITIC Dicastal CO., LTD, Hebei (CN)

(72) Inventors: Lin Zhu, Hebei (CN); Yule Zhou, Hebei (CN); Zhen Li, Hebei (CN)

( * ) Notice: Subject to any disclaimer, the term of this patent is extended or adjusted under 35 U.S.C. 154(b) by 244 days.

(21) Appl. No.: 15/673,707

(22) Filed: Aug. 10, 2017

(65) Prior Publication Data

US 2018/0369901 A1 Dec. 27, 2018

(30) Foreign Application Priority Data

Jun. 22, 2017 (CN) ..... 2017 1 0482417

(51) Int. Cl.
*B22C 9/06* (2006.01)
*B22C 9/28* (2006.01)
*B22D 18/04* (2006.01)

(52) U.S. Cl.
CPC ..... *B22C 9/065* (2013.01); *B22C 9/067* (2013.01); *B22C 9/28* (2013.01); *B22D 18/04* (2013.01)

(58) Field of Classification Search
CPC ..... B22C 9/065; B22C 9/28; B22D 15/005
See application file for complete search history.

(56) References Cited

U.S. PATENT DOCUMENTS

2004/0194906 A1* 10/2004 Baumgartner ..... B22C 9/088 164/135
2017/0266722 A1* 9/2017 Harimoto ..... B22C 9/06

FOREIGN PATENT DOCUMENTS

CN 203304530 U * 11/2013
CN 205673566 U * 11/2016

* cited by examiner

*Primary Examiner* — Kevin E Yoon
*Assistant Examiner* — Jacky Yuen

(57) ABSTRACT

A plunger for strengthening spoke root R angle cooling. A plunger main body is step-shaped and provided with a blind hole, and vent holes are uniformly distributed around the blind hole; an annular groove is formed in the plunger main body, and connects the blind hole with the vent holes; air outlet pipes are inserted into the blind hole, the distance between the air outlet pipes and the bottom of the blind hole is 1-1.5 times the radius of the blind hole, an annular air pipe connects the air inlet pipe with the air outlet pipes and distributes cooling air entering from an air inlet pipe to each air outlet pipe, and the diameter of the air inlet pipe is not smaller than two times that of the air outlet pipe.

4 Claims, 3 Drawing Sheets

PLUNGER FOR STRENGTHENING SPOKE ROOT R ANGLE COOLING

RELATED APPLICATION

This application claims priority to Chinese Patent Application No. 201710482417.X, filed on Jun. 22, 2017, which is hereby incorporated by reference in its entirety.

TECHNICAL FIELD

The utility model relates to a wheel mold.

BACKGROUND

In the production process of a low-pressure cast wheel mold, the hot spot at the root of an aluminum wheel spoke is a bottleneck constraining the production efficiency and the improvement on spoke performance all the time. In order to ensure cooling of this area, cooling of other parts is weakened by prolonging the production time in the prior art to wait solidification of the hot spot at the root.

SUMMARY

The invention provides a plunger for strengthening spoke hot spot cooling.

A plunger for strengthening spoke root R angle cooling includes: a plunger main body, a blind hole, vent holes, an annular groove, air outlet pipes, an annular air pipe, an air inlet pipe, a step transition surface, a I section fitting surface and a II section fitting surface. The plunger main body is step-shaped and provided with the blind hole, and the vent holes are uniformly distributed around the blind hole; the annular groove is formed in the plunger main body, and connects the blind hole with the vent holes; and the air outlet pipes are inserted into the blind hole. The annular air pipe connects the air inlet pipe with the air outlet pipes and distributes cooling air entering from the air inlet pipe to each air outlet pipe, and the diameter of the air inlet pipe is not smaller than two times that of the air outlet pipe.

The distance between the air outlet pipes and the bottom of the blind hole is 1-1.5 times the radius of the blind hole, and the quantity of the air outlet pipes is determined according to the structure of a product.

The width of the step transition surface is 2-4 mm; the plunger main body is provided with two fitting surfaces fitting a wheel mold, that is, the I section fitting surface and the II section fitting surface, the length of the I section fitting surface is within 10 mm, and a fitting clearance between the II section fitting surface and the wheel mold is 0.1-0.2 mm; and the roughness of the step transition surface and the I section fitting surface is required to be not less than 12.5.

The diameter of the vent hole is 1-2 mm, and the number of the vent holes is 18-40.

The plunger main body is connected with the wheel mold via a welding or thread.

In the invention, based on the difference of direct heat transfer and indirect heat transfer, thermal contact resistance is sufficiently utilized, the hot spot at the root is directly forcibly cooled, and other parts are configured to indirectly transfer heat by using the thermal contact resistance, so that the negative influence is furthest reduced.

Figure 1:
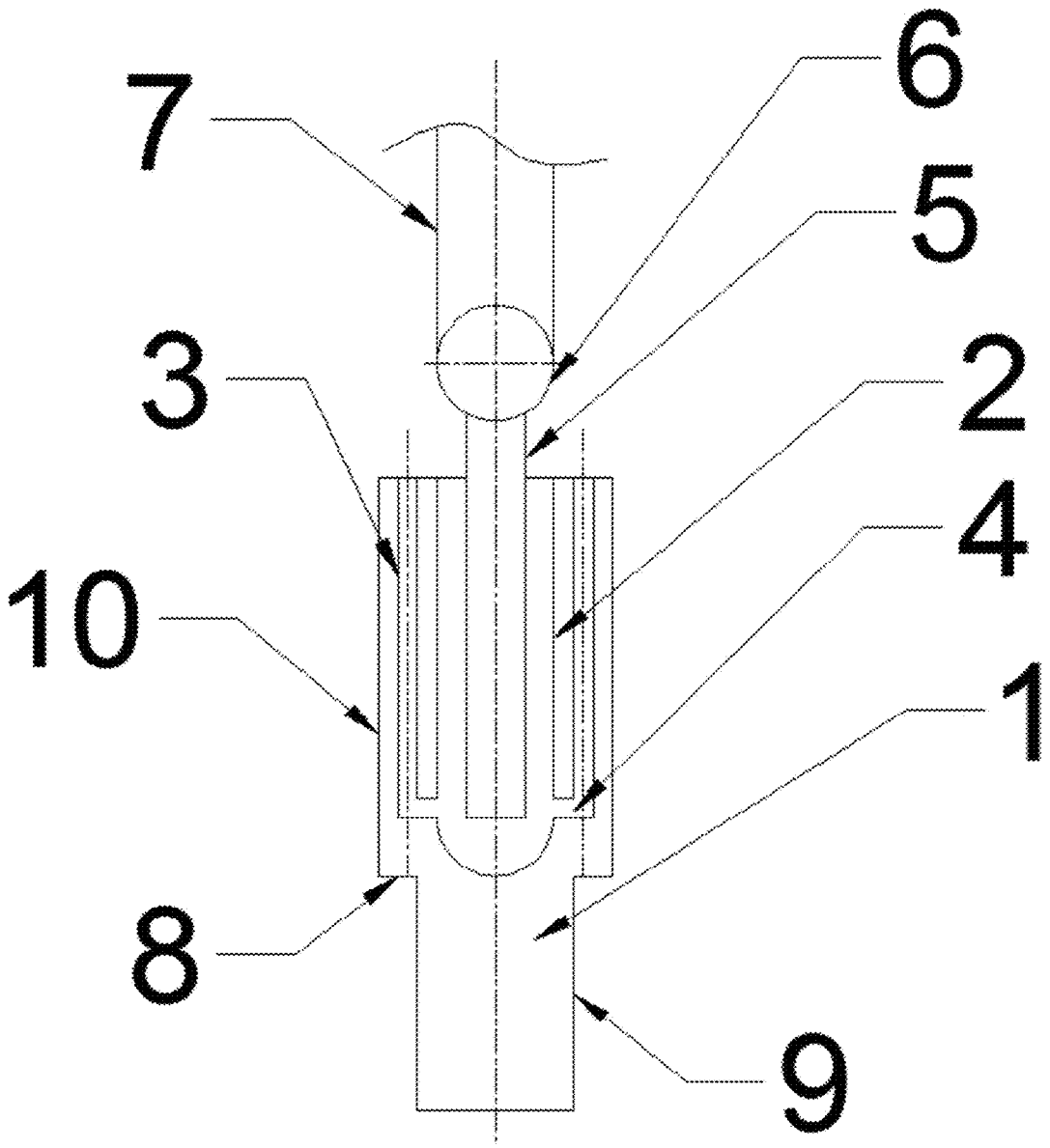
FIG. 1 is a front view of a plunger for strengthening spoke root R angle cooling according to the invention.
Figure 2:
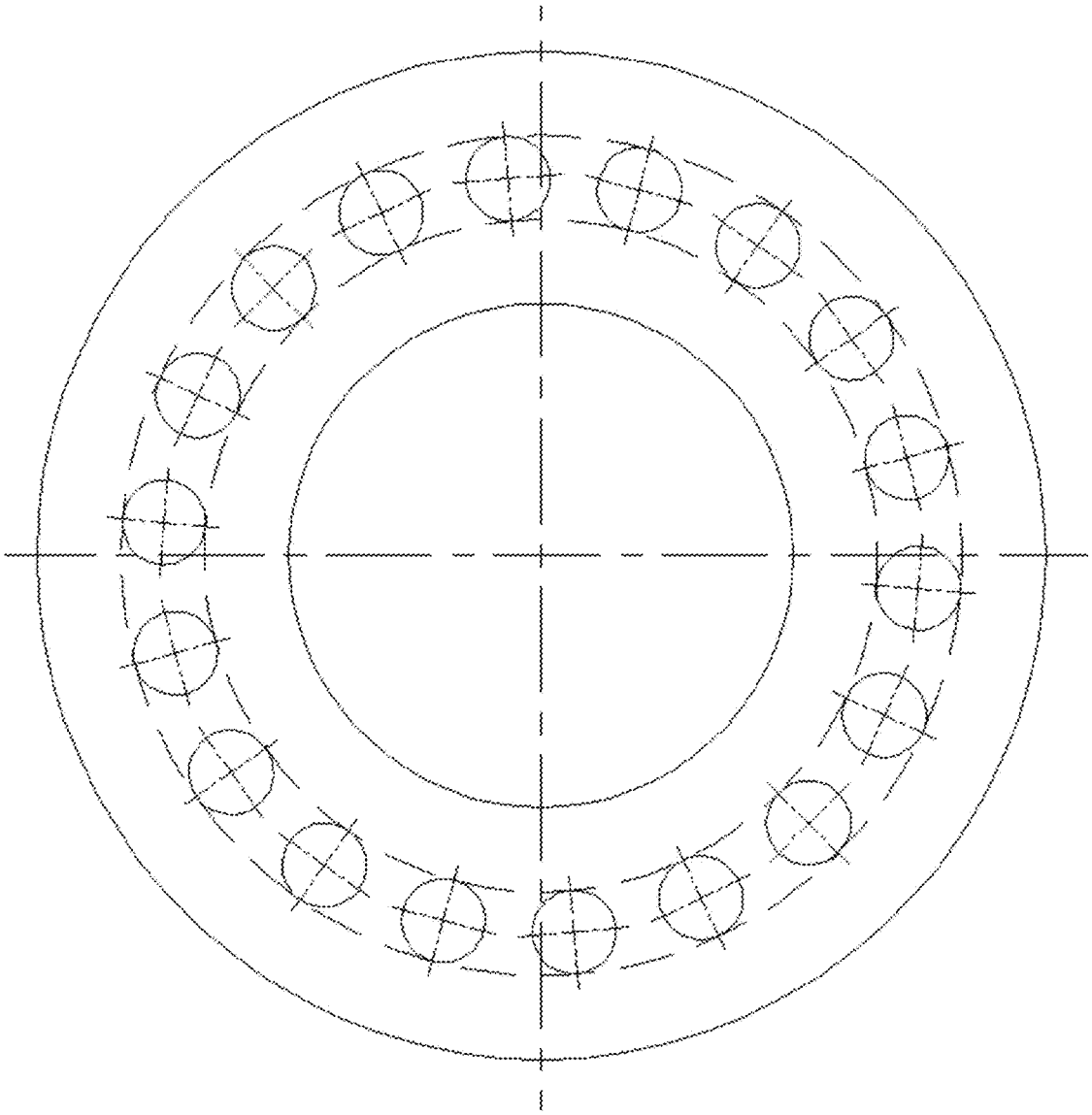
FIG. 2 is a top view of the plunger for strengthening spoke root R angle cooling according to the invention.
Figure 3:
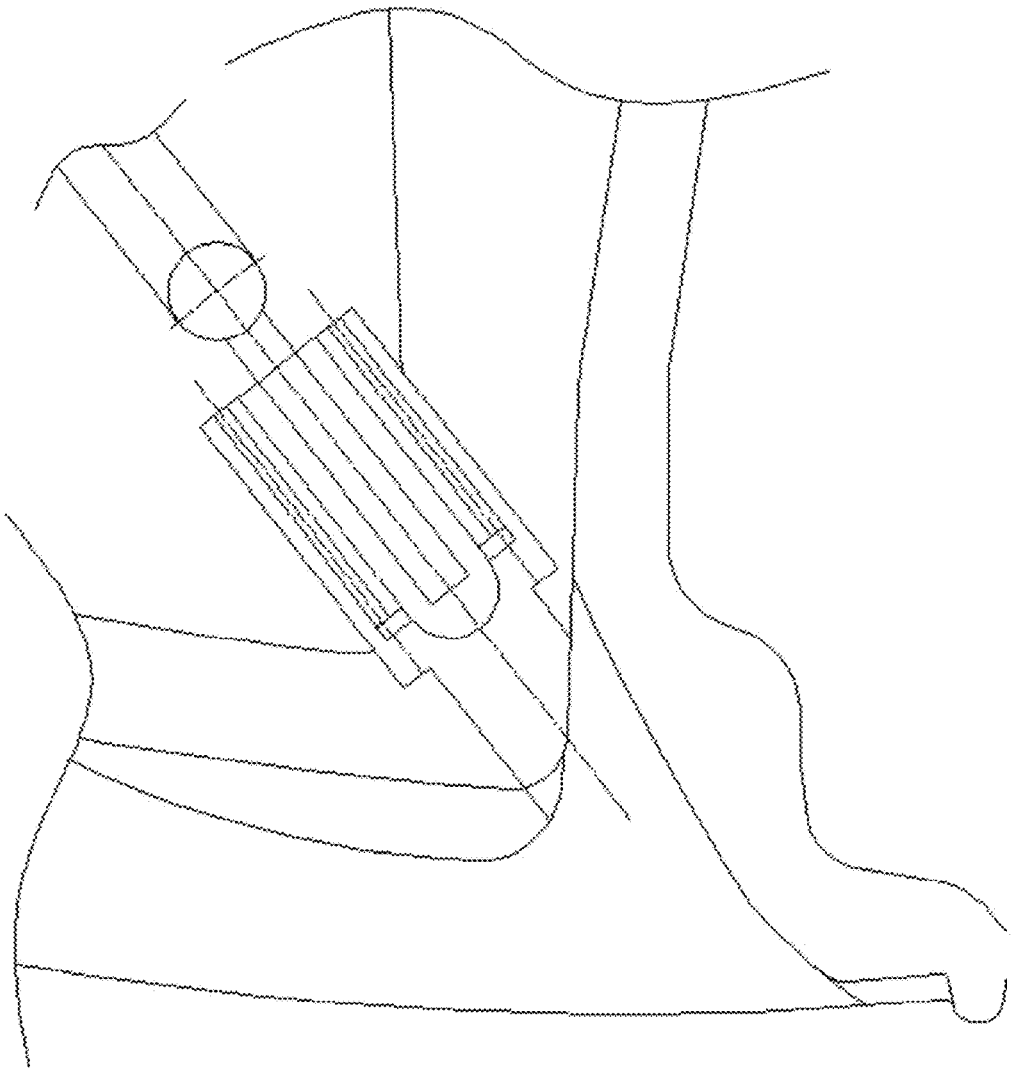
FIG. 3 is an assembly diagram of the plunger for strengthening spoke root R angle cooling according to the invention.

In which: 1—plunger main body, 2—blind hole, 3—vent hole, 4—annular groove, 5—air outlet pipe, 6—annular air pipe, 7—air inlet pipe, 8—step transition surface, 9—I section fitting surface, 10—II section fitting surface.

DETAILED DESCRIPTION OF THE EMBODIMENTS

Embodiment 1: A plunger for strengthening spoke root R angle cooling includes: a plunger main body 1, a blind hole 2, vent holes 3, an annular groove 4, air outlet pipes 5, an annular air pipe 6, an air inlet pipe 7, a step transition surface 8, a I section fitting surface 9 and a II section fitting surface 10.

The plunger main body 1 is step-shaped and provided with the blind hole 2, and the vent holes 3 are uniformly distributed around the blind hole 2; the annular groove 4 is formed in the plunger main body 1, and connects the blind hole 2 with the vent holes 3; and the air outlet pipes 5 are inserted into the blind hole 2. The annular air pipe 6 connects the air inlet pipe 7 with the air outlet pipes 5 and distributes cooling air entering from the air inlet pipe 7 to each air outlet pipe 5, and the diameter of the air inlet pipe 7 is two times that of the air outlet pipe 5.

The distance between the air outlet pipes 5 and the bottom of the blind hole 2 is the radius of the blind hole, and the quantity of the air outlet pipes 5 is determined according to the structure of a product.

The width of the step transition surface 8 is 2 mm; the plunger main body 1 is provided with two fitting surfaces fitting a wheel mold, that is, the I section fitting surface 9 and the II section fitting surface 10, the length of the I section fitting surface 9 is 8 mm, and a fitting clearance between the II section fitting surface 10 and the wheel mold is 0.1 mm; and the roughness of the step transition surface 8 and the I section fitting surface 9 is 12.5.

The diameter of the vent hole 3 is 1 mm, and the number of the vent holes 3 is 40.

The plunger main body 1 is connected with the wheel mold via a welding or thread.

Embodiment 2: A plunger for strengthening spoke root R angle cooling includes: a plunger main body 1, a blind hole 2, vent holes 3, an annular groove 4, air outlet pipes 5, an annular air pipe 6, an air inlet pipe 7, a step transition surface 8, a I section fitting surface 9 and a II section fitting surface 10.

The plunger main body 1 is step-shaped and provided with the blind hole 2, and the vent holes 3 are uniformly distributed around the blind hole 2; the annular groove 4 is formed in the plunger main body 1, and connects the blind hole 2 with the vent holes 3; and the air outlet pipes 5 are inserted into the blind hole 2. The annular air pipe 6 connects the air inlet pipe 7 with the air outlet pipes 5 and distributes cooling air entering from the air inlet pipe 7 to each air outlet pipe 5, and the diameter of the air inlet pipe 7 is 2.5 times that of the air outlet pipe 5.

The distance between the air outlet pipes 5 and the bottom of the blind hole 2 is 1.25 times the radius of the blind hole, and the quantity of the air outlet pipes 5 is determined according to the structure of a product.

The width of the step transition surface 8 is 3 mm; the plunger main body 1 is provided with two fitting surfaces fitting a wheel mold, that is, the I section fitting surface 9 and the II section fitting surface 10, the length of the I section fitting surface 9 is 7 mm, and a fitting clearance between the II section fitting surface 10 and the wheel mold is 0.15 mm; and the roughness of the step transition surface 8 and the I section fitting surface 9 is 13.5.

The diameter of the vent hole 3 is 1.5 mm, and the number of the vent holes 3 is 35.

The plunger main body 1 is connected with the wheel mold via a welding or thread.

Embodiment 3: A plunger for strengthening spoke root R angle cooling includes: a plunger main body 1, a blind hole 2, vent holes 3, an annular groove 4, air outlet pipes 5, an annular air pipe 6, an air inlet pipe 7, a step transition surface 8, a I section fitting surface 9 and a II section fitting surface 10.

The plunger main body 1 is step-shaped and provided with the blind hole 2, and the vent holes 3 are uniformly distributed around the blind hole 2; the annular groove 4 is formed in the plunger main body 1, and connects the blind hole 2 with the vent holes 3; and the air outlet pipes 5 are inserted into the blind hole 2. The annular air pipe 6 connects the air inlet pipe 7 with the air outlet pipes 5 and distributes cooling air entering from the air inlet pipe 7 to each air outlet pipe 5, and the diameter of the air inlet pipe 7 is 3 times that of the air outlet pipe 5.

The distance between the air outlet pipes 5 and the bottom of the blind hole 2 is 1.5 times the radius of the blind hole, and the quantity of the air outlet pipes 5 is determined according to the structure of a product.

The width of the step transition surface 8 is 4 mm; the plunger main body 1 is provided with two fitting surfaces fitting a wheel mold, that is, the I section fitting surface 9 and the II section fitting surface 10, the length of the I section fitting surface 9 is 6 mm, and a fitting clearance between the II section fitting surface 10 and the wheel mold is 0.2 mm; and the roughness of the step transition surface 8 and the I section fitting surface 9 is 14.5.

The diameter of the vent hole 3 is 2 mm, and the number of the vent holes 3 is 25.

The plunger main body 1 is connected with the wheel mold via a welding or thread.

The invention claimed is:

1. A plunger for strengthening spoke root R angle cooling, comprising a plunger main body, a blind hole, vent holes, an annular groove, air outlet pipes, an annular air pipe, an air inlet pipe, a step transition surface, a I section fitting surface and a II section fitting surface, characterized in that the plunger main body is step-shaped and provided with the blind hole, and the vent holes are uniformly distributed around the blind hole; the annular groove is formed in the plunger main body, and connects the blind hole with the vent holes; the air outlet pipes are inserted into the blind hole, the distance between the air outlet pipes and the bottom of the blind hole is 1-1.5 times the radius of the blind hole, the annular air pipe connects the air inlet pipe with the air outlet pipes and distributes cooling air entering from the air inlet pipe to each air outlet pipe, and the diameter of the air inlet pipe is not smaller than two times that of the air outlet pipe; the width of the step transition surface is 2-4 mm; the plunger main body is provided with two fitting surfaces fitting a wheel mold, that is, the I section fitting surface and the II section fitting surface, the length of the I section fitting surface is within 10 mm, and a fitting clearance between the II section fitting surface and the wheel mold is 0.1-0.2 mm; the roughness of the step transition surface and the I section fitting surface is required to be not less than 12.5; the diameter of the vent hole is 1-2 mm, and the number of the vent holes is 18-40; the plunger main body is connected with the wheel mold via a welding or thread.

2. The plunger for strengthening spoke root R angle cooling according to claim 1, characterized in that the diameter of the air inlet pipe is two times that of the air outlet pipe; the distance between the air outlet pipes and the bottom of the blind hole is the radius of the blind hole, and the width of the step transition surface is 2 mm; the plunger main body is provided with two fitting surfaces fitting a wheel mold, that is, the I section fitting surface and the II section fitting surface, the length of the I section fitting surface is 8 mm, and a fitting clearance between the II section fitting surface and the wheel mold is 0.1 mm; the roughness of the step transition surface and the I section fitting surface is 12.5; the diameter of the vent hole is 1 mm, and the number of the vent holes is 40.

3. The plunger for strengthening spoke root R angle cooling according to claim 1, characterized in that the diameter of the air inlet pipe is 2.5 times that of the air outlet pipe; the distance between the air outlet pipes and the bottom of the blind hole is 1.25 times the radius of the blind hole, and the width of the step transition surface is 3 mm; the plunger main body is provided with two fitting surfaces fitting a wheel mold, that is, the I section fitting surface and the II section fitting surface, the length of the I section fitting surface is 7 mm, and a fitting clearance between the II section fitting surface and the wheel mold is 0.15 mm; the roughness of the step transition surface and the I section fitting surface is 13.5; the diameter of the vent hole are 1.5 mm, and the number of the vent holes is 35.

4. The plunger for strengthening spoke root R angle cooling according to claim 1, characterized in that the diameter of the air inlet pipe is 3 times that of the air outlet pipe; the distance between the air outlet pipes and the bottom of the blind hole is 1.5 times the radius of the blind hole, and the width of the step transition surface is 4 mm; the plunger main body is provided with two fitting surfaces fitting a wheel mold, that is, the I section fitting surface and the II section fitting surface, the length of the I section fitting surface is 6 mm, and a fitting clearance between the II section fitting surface and the wheel mold is 0.2 mm; the roughness of the step transition surface and the I section fitting surface is 14.5; the diameter of the vent hole is 2 mm, and the number of the vent holes is 25.

* * * * *